US006615596B1

(12) United States Patent
Bass

(10) Patent No.: US 6,615,596 B1
(45) Date of Patent: Sep. 9, 2003

(54) DEHUMIDIFICATION SYSTEM USING MEDIUM TO LOW TEMPERATURE REFRIGERATION

(76) Inventor: James A. Bass, 3371 NW. 168 St., Miami, FL (US) 33056

( * ) Notice: Subject to any disclaimer, the term of this patent is extended or adjusted under 35 U.S.C. 154(b) by 0 days.

(21) Appl. No.: 10/068,653

(22) Filed: Feb. 6, 2002

(51) Int. Cl.[7] ..... F25D 21/02; G05D 23/32
(52) U.S. Cl. ..... 62/140; 62/152; 62/158
(58) Field of Search ..... 62/140, 152, 139, 62/151, 157, 158, 78, 272, 199, 200, 231, 234

(56) References Cited

U.S. PATENT DOCUMENTS 4,439,998 A * 4/1984 Horvay et al. ..... 62/199
4,474,026 A * 10/1984 Mochizuki et al. ..... 62/157
4,873,837 A * 10/1989 Murray ..... 62/199
6,295,825 B1 * 10/2001 Jin ..... 62/238.7

* cited by examiner

*Primary Examiner*—Chen Wen-Jiang
(74) *Attorney, Agent, or Firm*—Edward P. Dutkiewicz

(57) ABSTRACT

A dehumification/refrigeration system has a first suction stop valve, first evaporator and first timer control contact and a second suction stop valve, second evaporator and second timer control contact. The first suction stop valve is adapted to inactivate the first evaporator upon the detection of ice and to activate the second suction stop valve and second evaporator. The second suction stop valve is adapted to inactivate the second evaporator upon the detection of ice and to activate the first suction stop valve and first evaporator. A supplemental relay and an associated third timer control contact simultaneously activate the first timer and second control contacts. A timer sequentially activates one timer control contact to the exclusion of the others.

3 Claims, 8 Drawing Sheets

FIG 2A
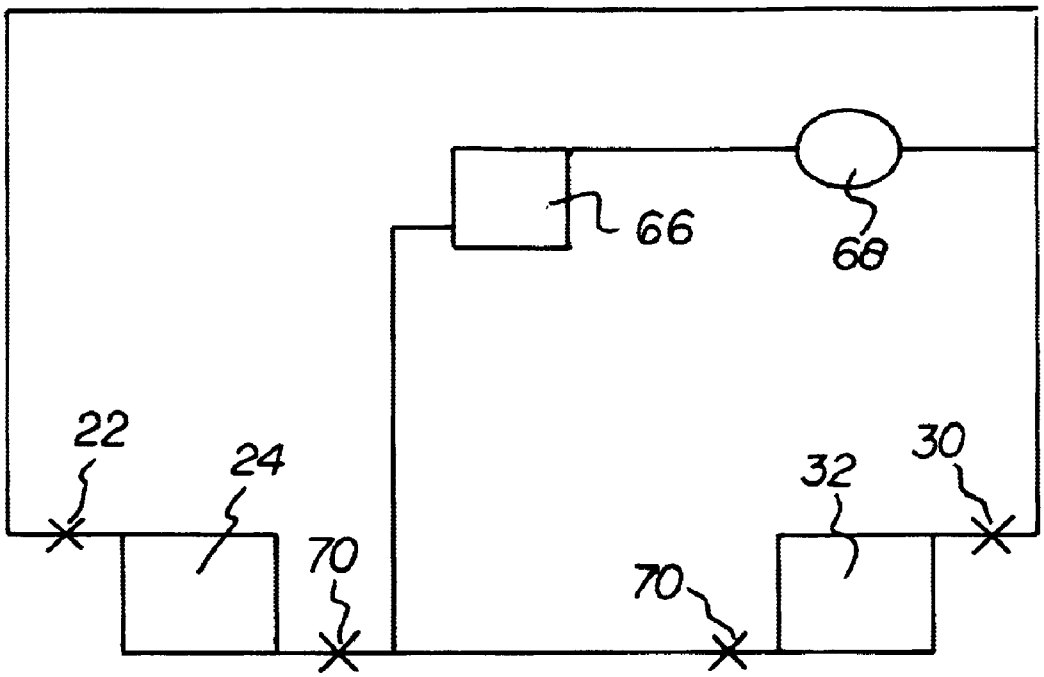
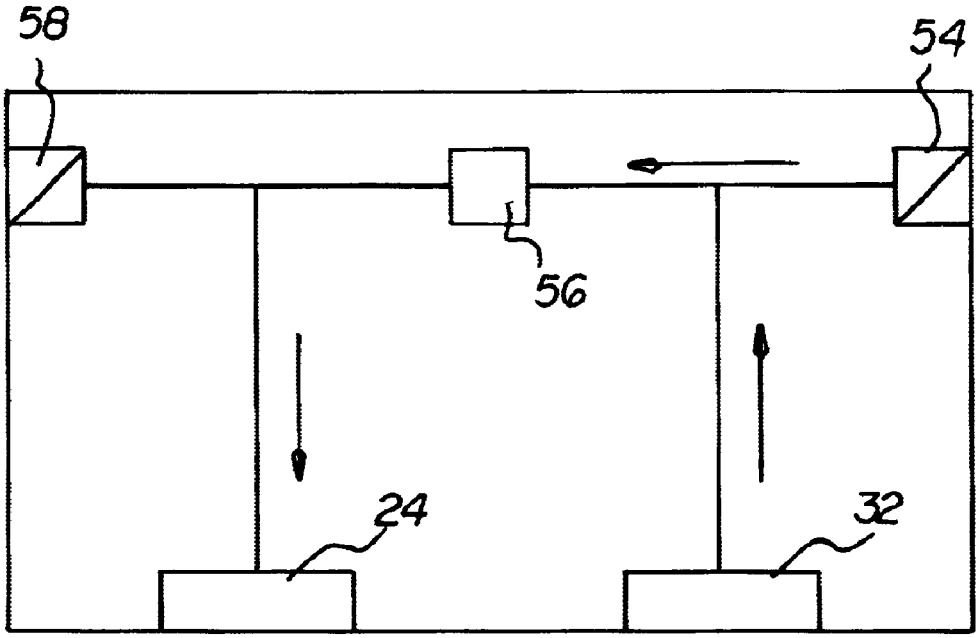
FIG 2B

FIG 3A
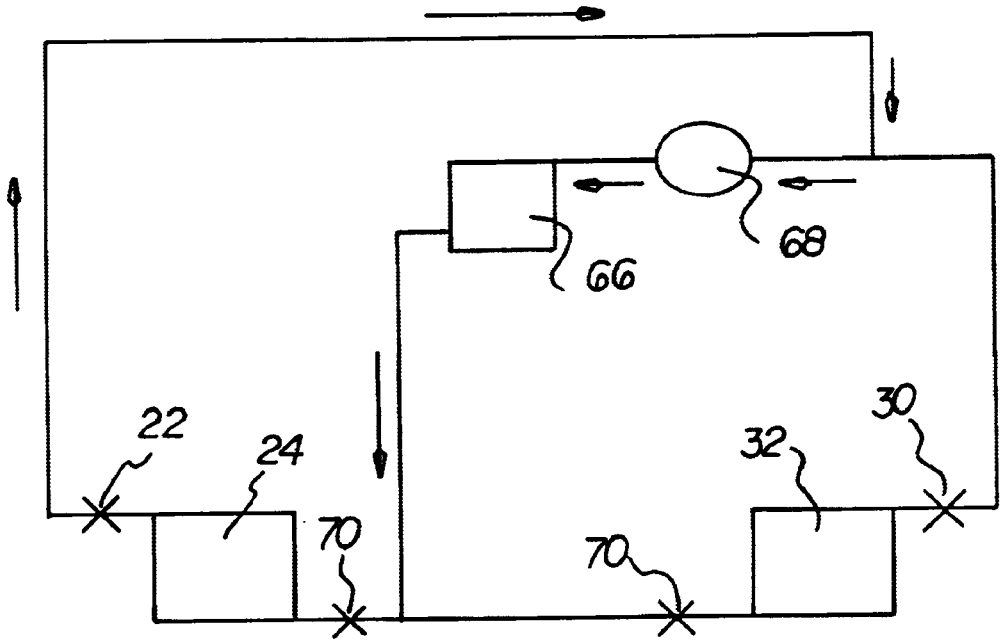
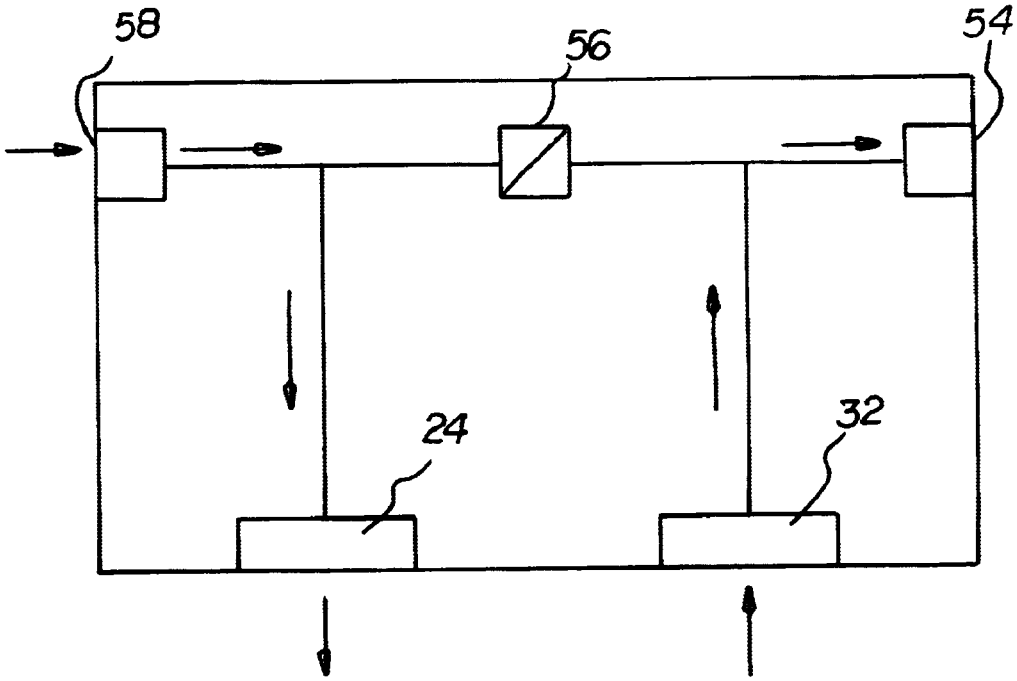
FIG 3B

FIG 4A
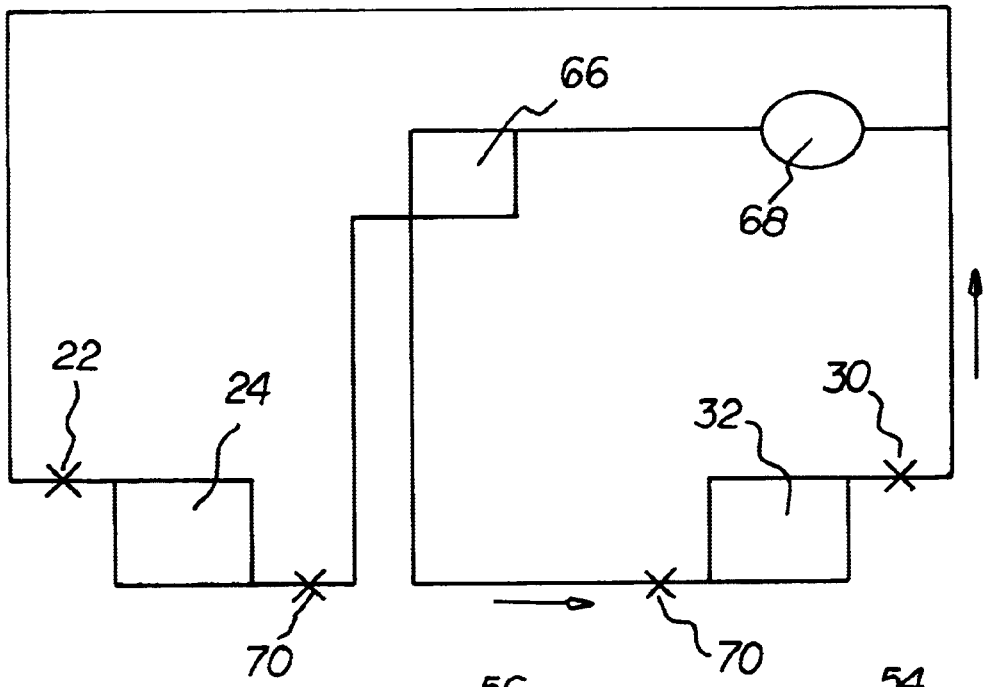
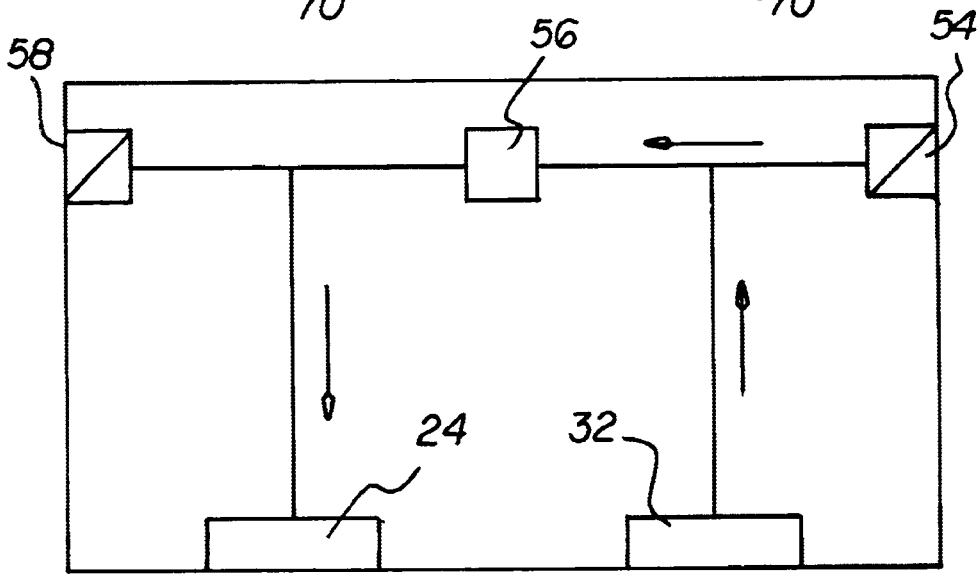
FIG 4B

FIG 5
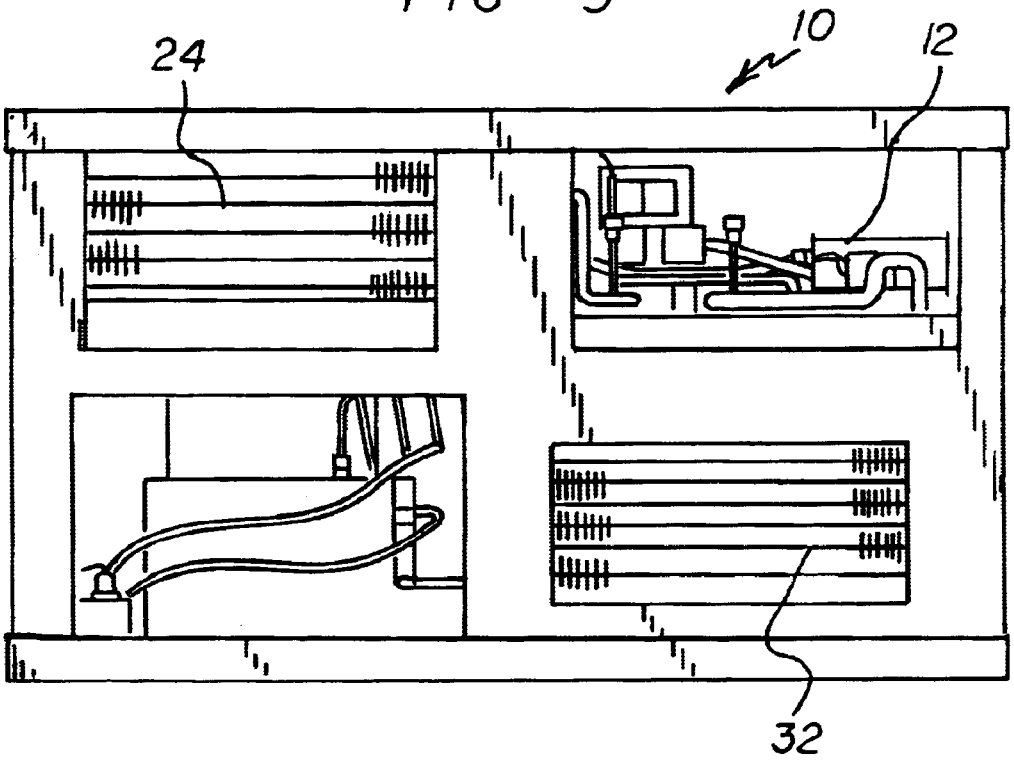
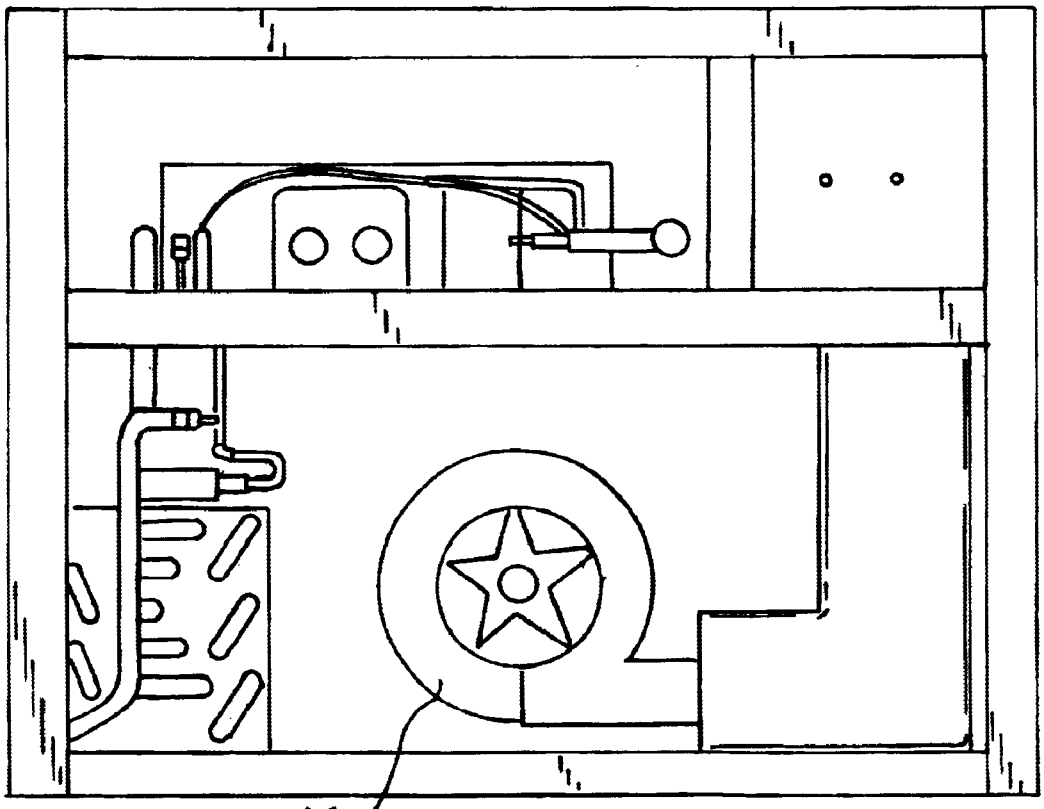
FIG 6

FIG 7
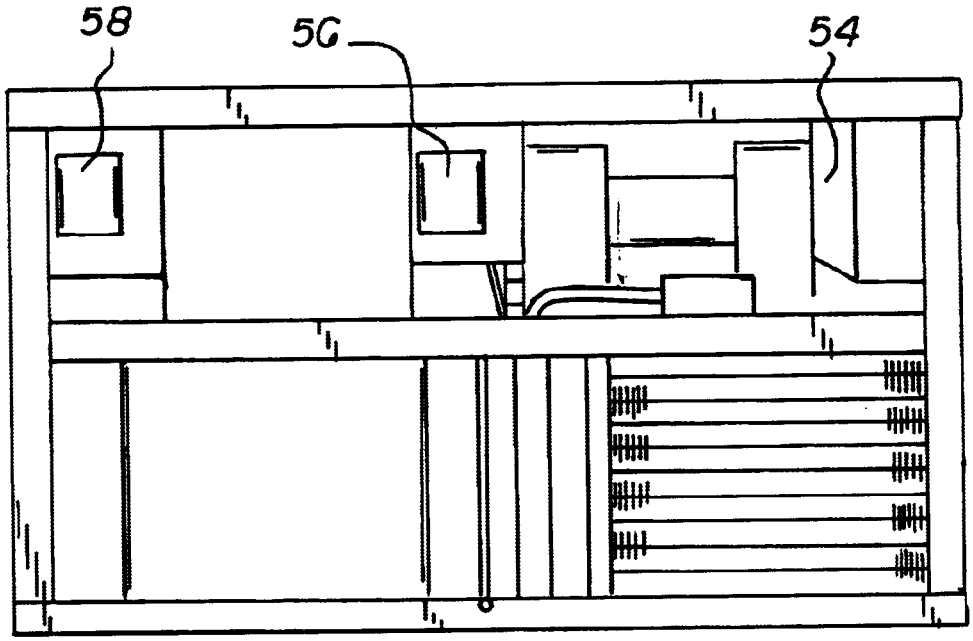
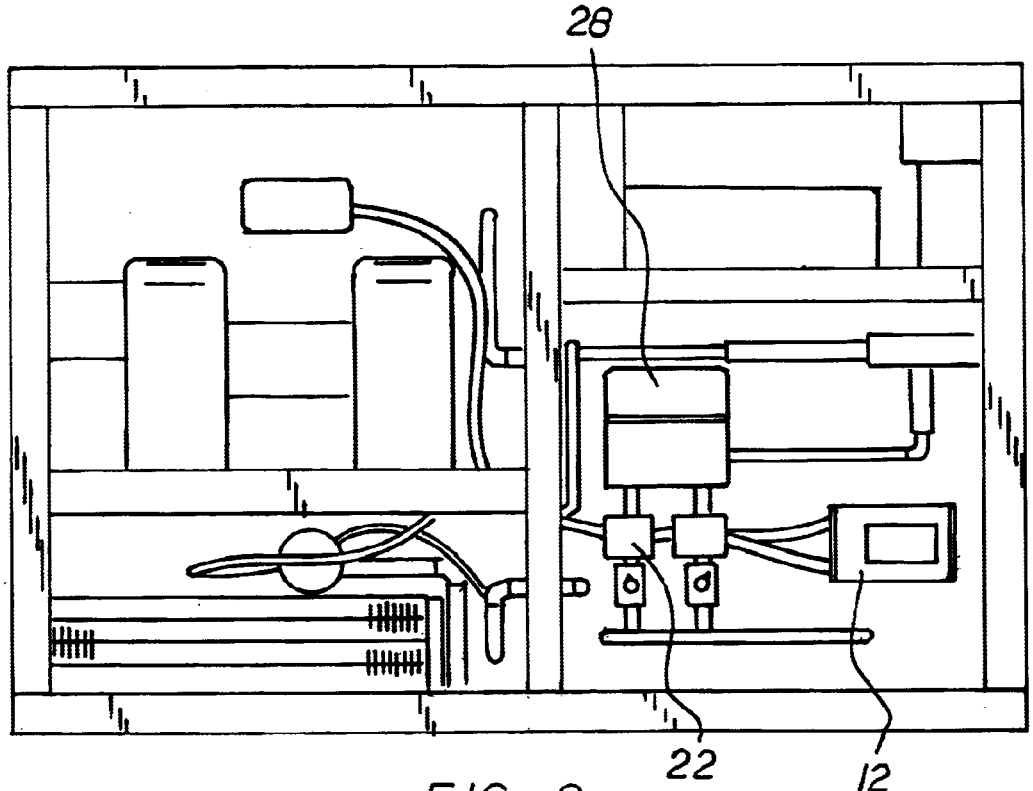
FIG 8

DEHUMIDIFICATION SYSTEM USING MEDIUM TO LOW TEMPERATURE REFRIGERATION

BACKGROUND OF THE INVENTION

1. Field of the Invention

The present invention relates to a dehumification system using medium to low temperature refrigeration and more particularly pertains to maximizing cooling while minimizing humidity and carbon dioxide in a chamber.

2. Description of the Prior Art

The use of dehumidification/refrigeration systems and air conditioning systems of known designs and configurations is known in the prior art. More specifically, dehumidification/ refrigeration systems and air conditioners of known designs and configurations previously devised and utilized for the purpose of increasing the comfort in a room or building through known designs and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,301,744 issued Apr. 12, 1994 to Dirks discloses a modular air conditioning system. Further, U.S. Pat. No. 5,279,609 issued Jan. 18, 1994 to Heckler discloses an air quality-temperature controlled central conditioner and multi-zone conditioning.

While these devices fulfill their respective, particular objectives and requirements, the aforementioned patents do not describe a dehumification/refrigeration system that allows maximizing cooling while minimizing humidity and carbon dioxide in a chamber.

In this respect, the dehumification/refrigeration system according to the present invention substantially departs from the conventional concepts and designs of the prior art, and in doing so provides an apparatus primarily developed for the purpose of maximizing cooling while minimizing humidity and carbon dioxide in a chamber.

Therefore, it can be appreciated that there.exists a continuing need for a new and improved dehumification/ refrigeration system which can be used for maximizing cooling while minimizing humidity and carbon dioxide in a chamber. In this regard, the present invention substantially fulfills this need.

SUMMARY OF THE INVENTION

In view of the foregoing disadvantages inherent in the known types of dehumidification/refrigeration of known designs and configurations now present in the prior art, the present invention provides an improved dehumidification/ refrigeration system. As such, the general purpose of the present invention, which will be described subsequently in greater detail, is to provide a new and improved dehumidification/refrigeration system and method which has all the advantages of the prior art and none of the disadvantages. To attain this, the present invention essentially comprises a transformer for converting an incoming 110 volts alternating current to an operating 24 volts direct current. Next provided is a first fan motor. An associated first fan motor contact is provided for activating the first fan motor. A second fan motor is next provided. An associated second fan motor contact is provided for activating the second fan motor. Next provided are a first suction stop valve, first evaporator, and an in-line first timer control contact. An associated first pressure switch is provided between the first suction stop valve and first timer control contact. A second suction stop valve, a second evaporator and an in-line second timer control contact are next provided. An associated second pressure switch is provided between the second suction stop valve and second timer control contact. The first suction stop valve is coupled to the second suction stop valve to inactivate the first fan and first evaporator upon the detection of ice on the first evaporator and to activate the second suction stop valve and second motor and second evaporator. The second suction stop valve is coupled to the first suction stop valve to inactivate the second fan and second evaporator upon the detection of ice on the second evaporator and to activate the first suction stop valve and first motor and first evaporator. Next provided is a supplemental relay. An associated in-line third timer control contact simultaneously activates the first fan motor contact and the second fan motor contact. A first supplemental contact is provided between the first suction stop valve and the second supplemental contact and a second supplemental contact is provided between the second supplemental contact and the supplemental relay for also simultaneously activating the first suction stop valve and first evaporator and the second suction stop valve and a second evaporator. A first fan relay is provided. The first fan relay is coupled to the first pressure switch and the first timer control contact for activating the first fan upon activating the first timer control contact. Next provided is a second fan relay. The second fan relay is coupled to the second pressure switch and the second timer control contact for activating the second fan upon activating the second timer control contact. A second fan relay contact couples the first fan relay and second fan relay. A plurality of dampers are provided. The dampers include a first damper for the exhausting of air from the system, a second damper for precluding the flow of air between the first fan and the second fan, and a third damper for the receipt of air into the system. Lastly, a timer is provided. The timer sequentially activates one timer control contact to the exclusion of the others whereby the system may function (a) in a first after hours mode with the first timer control contact closed with the second evaporator energized and the first evaporator de-energized and with the first and third dampers closed and the second damper open, and (b) in a second fresh air mode with the second timer control contact closed with the first evaporator energized and the second evaporator de-energized and with the first and third dampers open and the second damper closed, and (c) a third cooling mode with the third timer control contact closed with the first and second evaporators energized and with the first and third dampers closed and the second damper open.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dehumidification/refrigeration system which has all of the advantages of the prior art air conditioners of known designs and configurations and none of the disadvantages.

It is another object of the present invention to provide a new and improved dehumidification/refrigeration system which may be easily and efficiently manufactured and marketed.

It is further an object of the present invention to provide a new and improved dehumidification/refrigeration system which is of durable and reliable constructions.

An even further object of the present invention is to provide a new and improved dehumidification/refrigeration system which is susceptible of a low cost of manufacture with regard to both materials and labor, and which accordingly is then susceptible of low prices of sale to the consuming public, thereby making such dehumidification/refrigeration system economically available to the buying public.

Even still another object of the present invention is to provide a dehumidification/refrigeration system for maximizing cooling while minimizing humidity and carbon dioxide in a chamber.

Lastly, it is an object of the present invention to provide a new and improved dehumidification/refrigeration system having a first suction stop valve, first evaporator and first timer control contact and a second suction stop valve, second evaporator and second timer control contact. The first suction stop valve is adapted to inactivate the first evaporator upon the detection of ice and to activate the second suction stop valve and second evaporator. The second suction stop valve is adapted to inactivate the second evaporator upon the detection of ice and to activate the first suction stop valve and first evaporator. A supplemental relay and an associated third timer control contact simultaneously activate the first timer and second control contacts. A timer sequentially activates one timer control contact to the exclusion of the others.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 2A and 2B are schematic illustrations of the refrigerant flow and air flow of the system when in a first or after hours mode.

FIGS. 3A and 3B are schematic illustrations of the refrigerant flow and air flow of the system when in a second or fresh air mode.

FIGS. 4A and 4B are schematic illustrations of the refrigerant flow and air flow of the system when in a third or cooling mode.

FIG. 5 is a front elevational view illustrating the dehumidification/refrigeration system described in the prior Figures.

FIG. 6 is a right side elevational view illustrating the dehumidificaiton/refrigeration system described in the prior Figures.

FIG. 7 is a rear elevational view illustrating the air conditioning system described in the prior Figures.

FIG. 8 is a top plan view illustrating the dehumidification/refrigeration system described in the prior Figures.

The same reference numerals refer to the same parts throughout the various Figures.

DESCRIPTION OF THE PREFERRED EMBODIMENT

Figure 1:
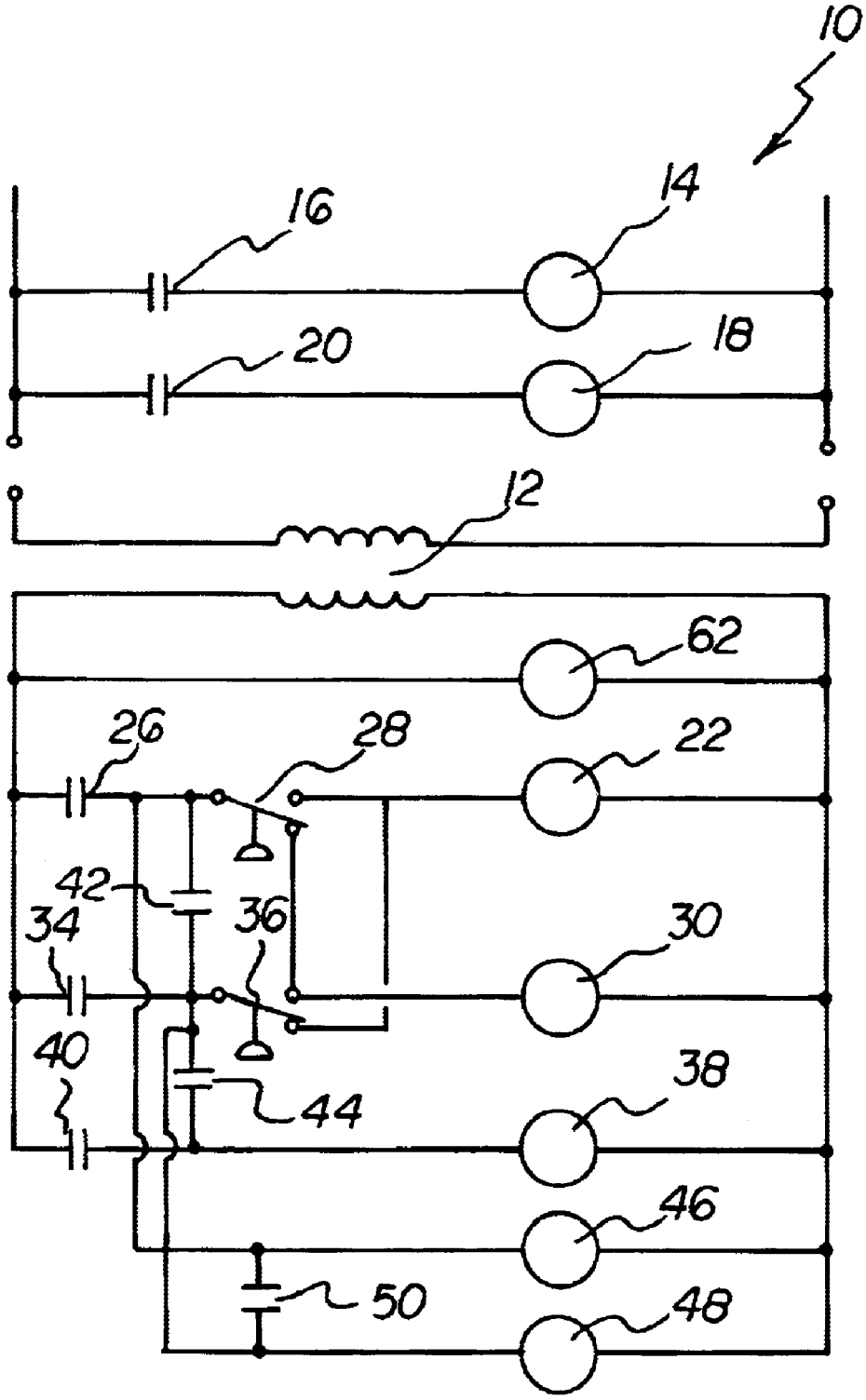
FIG. 1 is an electrical schematic for a dehumidification/refrigeration system constructed in accordance with the principles of the present invention.
Figure 9:
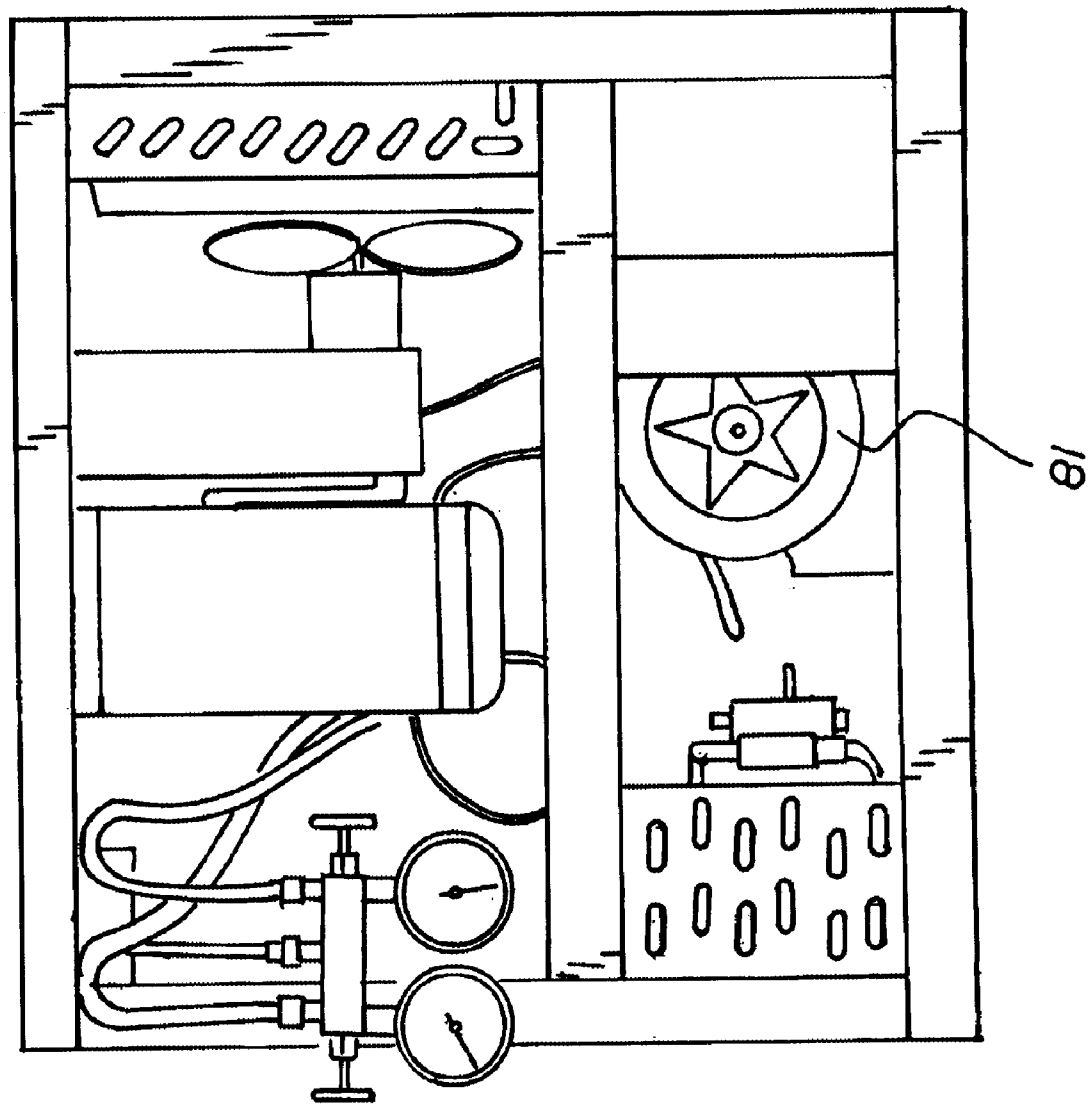
FIG. 9 is a left elevational view illustrating the dehumidification/refrigeration system described in the prior Figures.

With reference now to the drawings, and in particular to FIG. 1 thereof, the preferred embodiment of the new and improved dehumificiation/refrigeration system embodying the principles and concepts of the present invention and generally designated by the reference numeral 10 will be described.

The present invention, the dehumidification/refrigeration system 10 is comprised of a plurality of components. Such components in their broadest context include a first suction stop valve, evaporator and timer control contact; a second suction stop valve, evaporator and timer control contact; a supplemental relay system; and a timer. Such components are individually configured and correlated with respect to each other so as to attain the desired objective.

First provided is a transformer 12 for converting an incoming 110 volts alternating current to an operating 24 volts direct current.

Next provided is a first fan motor 14. An associated first fan motor contact 16 is provided for activating the first fan motor.

A second fan motor 18 is next provided. An associated second fan motor contact 20 is provided for activating the second fan motor.

Next provided are a first suction stop valve 22, first evaporator 24, and an in-line first timer control contact 26. An associated first pressure switch 28 is provided between the first suction stop valve and first timer control contact.

A second suction stop valve 30, a second evaporator 32 and an in-line second timer control contact 34 are next provided. An associated second pressure switch 36 is provided between the second suction stop valve and second timer control contact. The first suction stop valve is coupled to the second suction stop valve to inactivate the first fan and first evaporator upon the detection of ice on the first evaporator and to activate the second suction stop valve and second motor and second evaporator. The second suction stop valve is coupled to the first suction stop valve to inactivate the second fan and second evaporator upon the detection of ice on the second evaporator and to activate the first suction stop valve and first motor and first evaporator.

Another aspect of the present invention is the utilization of a decreased number of fins on the evaporators, preferably about eight fins per inch as sued in freezers rather than the twelve fins per inch as used in air conditioners. This maximizes the efficiency of the system during operation and use.

Next provided is a supplemental relay 38. An associated in-line third timer control contact 40 simultaneously activates the first fan motor contact and the second fan motor contact. A first supplemental contact 42 is provided between the first suction stop valve and the second supplemental contact and a second supplemental contact 44 is provided between the second supplemental contact and the supplemental relay for also simultaneously activating the first suction stop valve and first evaporator and the second suction stop valve and a second evaporator.

A first fan relay 46 is provided. The first fan relay is coupled to the first pressure switch and the first timer control contact for activating the first fan upon activating the first timer control contact.

Next provided is a second fan relay 48. The second fan relay is coupled to the second pressure switch through as et of contacts 50 and the second timer control contact for activating the second fan upon activating the second timer control contact. A second fan relay contact couples the first fan relay and second fan relay.

A plurality of dampers are provided. The dampers include a first damper 54 for the exhausting of air from the system, a second damper 56 for precluding the flow of air between the first fan and the second fan, and a third damper 58 for the receipt of air into the system. The system is arranged with dampers preferably on the sides for the flow of supply and exhaust air between the system and the atmosphere. The flow of supply and exhaust air between the system and the building, room or other chamber to be conditioned is preferably from the bottom of the system.

Lastly, a timer 62 is provided. The timer sequentially activates one timer control contact to the exclusion of the others whereby the system may function (a) in a first after hours mode with the first timer control contact closed with the second evaporator energized and the first evaporator de-energized and with the first and third dampers closed and the second damper open, and (b) in a second fresh air mode with the second timer control contact closed with the first evaporator energized and the second evaporator de-energized and with the first and third dampers open and the second damper closed, and (c) a third cooling mode with the third timer control contact closed with the first and second evaporators energized and with the first and third dampers closed and the second damper open.

Shown in the various Figures are supplemental components including (a) an air condensing unit 66 with a conventional refrigeration unit, (b) a conventional crankcase pressure regulator 68 for controlling the pressure to preclude overloading and (c) a conventional metering device as, for example, an expansion valve or a cap tube.

The time clock will have the unit in fresh air mode from 9 AM to 3 PM. This will allow for fresh air to come in when the space is occupied. At 3 PM, the time clock will switch modes and the unit will be in the after hours mode until 9 AM the next day. Time can be adjusted to different application.

The pressure controls will measure the suction pressure, and when the pressure drops to a predetermined setting, the unit will switch from after hours mode to fresh air mode. This will allow for any ice that is built up to melt.

Since the unit BTU capacity is so small, the unit will probably always run in one mode or another.

When the humidity drops below a certain setting, the humidistat will allow the unit to switch to either a cooling or heating mode.

The way the unit is designed, no extra reheat coil is needed. A damper between the condensing unit department and supply air back to the space, may be opened to reheat the supply air.

This unit may also be set up as a heat pump, allowing for heating in winter months.

A pressure control is installed in each coil. When the pressure in the coil drops below a predetermined setting, the solenoid stops the cooling process. This will allow for any ice that is built up to melt. When the pressure rises, the solenoid energizes. The coil then starts either its cooling process, or it's humidity process. For example, in the dehumidifying mode, pressure in #2 evaporator goes below the set point. Solenoid #2 de-energizes, and solenoid #1 energizes.

Due to the location of the unit and the amount of moisture that is extracted from the space, the drain line allows the water to drain to the outside.

The time clock will allow for three switching positions:

1) cooling mode,
2) fresh air mode, and
3) after hours mode.

For example, a school needs three different applications which are:

1) Beginning around 9 AM the carbon dioxide level starts to climb and the unit will switch to the fresh air mode.
2) Around 3 PM the students leave the classroom and the carbon dioxide level drops to below 1,000 PPM. At this time, the unit switches to the cooling mode until 10 PM when the school is shut down. The cooling mode allows the main A/C or chiller to shut down and save energy;
3) Around 10 PM the unit switches to full dehumidification mode, which allows some cooling at night. However, this is mainly dehumidification. At 9 AM the cycle starts over again.

This application will run for five days, and on the weekends it will run in the dehumidification mode.

The main difference between this machine and any other machine is the use of the two different evaporator coils. The splitting and arrangement of the fans and coils allow for three different capabilities. In the after hours mode, only one evaporator coil is used. This allows for the evaporator to run at a colder temperature, therefore, allowing greater moisture removal. In the fresh air mode, the other evaporator is used, allowing the fresh air to be dehumidified before entering the condition spaced. During the cooling mode, both evaporators are used to dehumidify, which allows the space to cool.

In a typical school, the unit will run in the fresh air mode while the students are in the classroom. This will allows the dehumidified fresh air to enter the classroom, and the stale air, with a high carbon dioxide content, to be exhaust.

After the students leave, the main A/C or chiller can be shut down, and the cooling will remain while custodial staff is in the school This will save a tremendous amount of electricity, therefore, lowering the power bills, turning energy dollars into educational dollars. When the custodial staff leaves, the unit will switch to the after hours mode, and will continually dehumidify at night.

This method requires very little energy consumption, and will solve the mold, mildew, and high carbon dioxide problems in the schools and public places.

Figure 10:
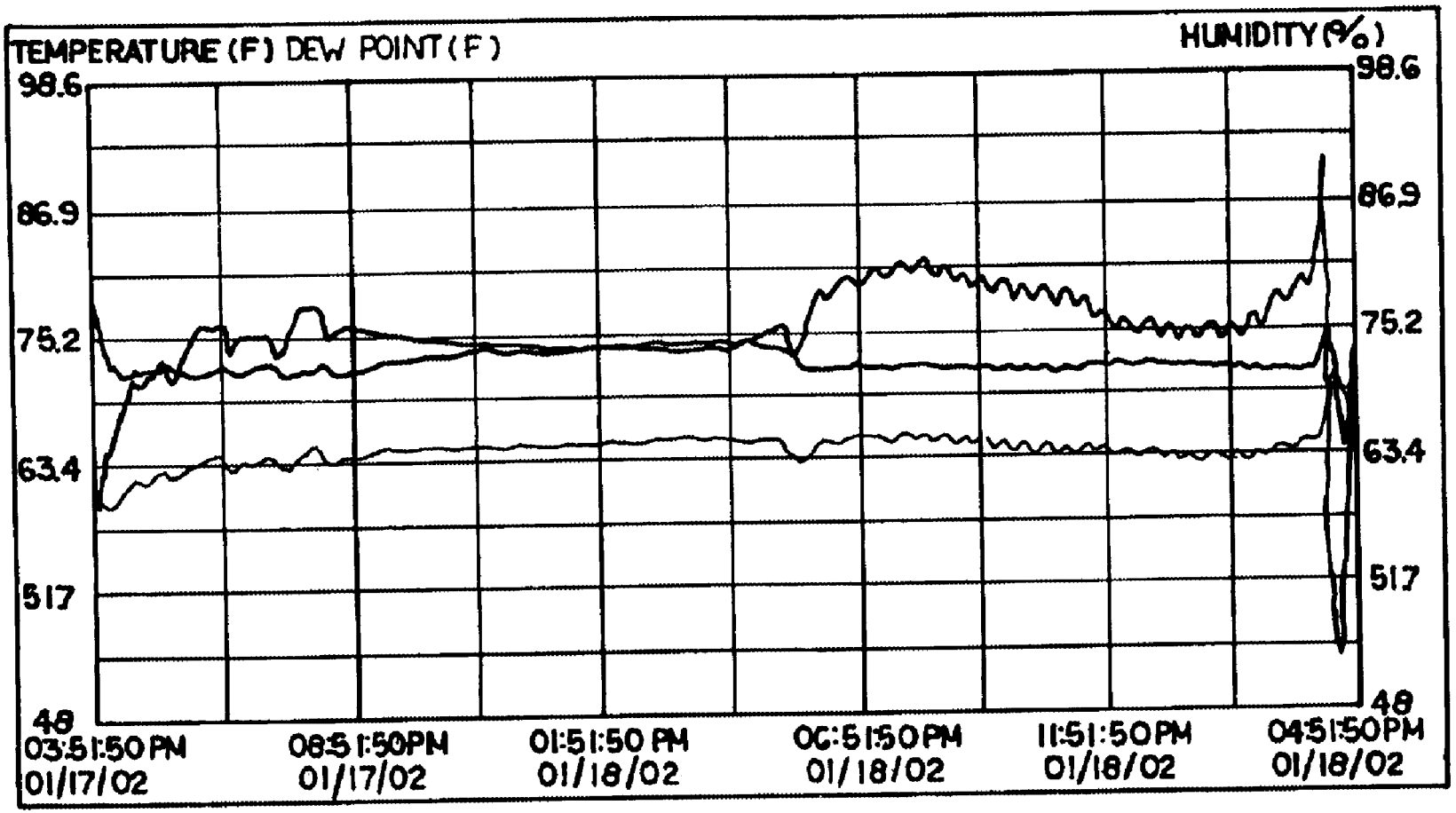
FIG. 10 is a graph demonstrating the temperature and humidity over time in a chamber equipped with the present invention.

With reference to FIG. 10, this data is a typical school with mold and mildew problems. Beginning around 3 PM the students vacate the classrooms and there is not enough heat load to keep the cooling and dehumidifying process active. The thermostat shuts off the cooling and due to the fresh air having high moisture content the relative humidity starts to rise. Between 3 PM and 8:30 PM the RH rises from 64 percent to 75 percent at 8:30 until 4:30. The chilling process and exhaust fan shut down and the RH remains relatively constant until 4:30 AM. The chilling and exhaust systems restart. The RH factor continues to rise because chill water is not bringing the temperature in the coil below the dew point temperature. The RH does not decline until approximately 5:30 AM. By 6:00 AM the thermostat starts cycling the cooling process and RH continues to rise until approximately 8:30 when the students become the heat load. The humidity begins to go down until the thermostat cycles the cooling process. Depending on the heat load inside and outside will determine the cycling rate. At 3:00 PM the students leave and the process continues.

This invention does not depend on the load to continually dehumidify. Due to the actions of this invention, no cooling or heating enters the classroom. There is no thermostat to shut the dehumidifying process down. It will only stop full dehumidifying during the fresh air mode. During the fresh air mode, the fresh air is dehumidified before entering the classroom. The time clock will allow how long the fresh air mode is and how long the dehumidify time is. In the typical school the fresh air mode will be between 9:00 AM and 3:00 PM allowing for 18 hours of dehumidification, five days a week, and 24 hours on Saturday and Sunday.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An dehumidification/refrigeration system for maximizing cooling while minimizing humidity and carbon dioxide in a chamber comprising, in combination:

a transformer for converting an incoming 110 volts alternating current to an operating 24 volts direct current;

a first fan motor with an associated first fan motor contact for activating the first fan motor;

a second fan motor with an associated second fan motor contact for activating the second fan motor;

a first suction stop valve and first evaporator and an in-line first timer control contact with an associated first pressure switch between the first suction stop valve and the first timer control contact;

a second suction stop valve and a second evaporator and an in line second timer control contact with an associated second pressure switch between the second suction stop valve and the second timer control contact, the first suction stop valve coupled to the second suction stop valve to inactivate the first fan and first evaporator upon the detection of ice on the first evaporator and to activate the second suction stop valve and second motor and second evaporator, the second suction stop valve coupled to the first suction stop valve to inactivate the second fan and second evaporator upon the detection of ice on the second evaporator and to activate the first suction stop valve and first motor and first evaporator;

a supplemental relay and an associated in-line third timer control contact for simultaneously activating the first fan motor contact and the second fan motor contact, and a first supplemental contact between the first suction stop valve and the second supplemental contact and a second supplemental contact between the second supplemental contact and the supplemental relay for also simultaneously activating the first suction stop valve and first evaporator and the second suction stop valve and a second evaporator;

a first fan relay coupled to the first pressure switch and the first timer control contact for activating the first fan upon activating the first timer control contact;

a second fan relay coupled to the second pressure switch and the second timer control contact for activating the second fan upon activating the second timer control contact with a second fan relay contact coupling the first fan relay and second fan relay;

a plurality of dampers including a first damper for the exhausting of air from the system, a second damper for precluding the flow of air between the first fan and the second fan and a third damper for the receipt of air into the system; and a timer to sequentially activate one timer control contact to the exclusion of the others whereby the system may function (a) in a first after hours mode with the first timer control contact closed with the second evaporator energized and the first evaporator de-energized and with the first and third dampers closed and the second damper open, and (b) in a second fresh air mode with the second timer control contact closed with the first evaporator energized and the second evaporator de-energized and with the first and third dampers open and the second damper closed, and (c) a third cooling mode with the third timer control contact closed with the first and second evaporators energized and with the first and third dampers closed and the second damper open.

2. A dehumidification/refrigeration system comprising:

a first suction stop valve and first evaporator and a first timer control contact;

a second suction stop valve and a second evaporator and a second timer control contact, the first suction stop valve adapted to inactivate the first evaporator upon the detection of ice and to activate the second suction stop valve and second evaporator, the second suction stop valve adapted to inactivate the second evaporator upon the detection of ice and to activate the first suction stop valve and first evaporator;

a supplemental relay and an associated third timer control contact for simultaneously activating the first timer and second control contacts;

a timer to sequentially activate one timer control contact to the exclusion of the others; and a plurality of fans and a plurality of dampers including a first fan and a first damper for the exhausting of air from the system, the second fan and a second damper for precluding the flow of air between the first fan and the second fan and a third damper for the receipt of air into the system.

3. The system as set forth in claim 2 whereby the system may function (a) in a first after hours mode with the first timer control contact closed with the second evaporator energized and the first evaporator de-energized and with the first and third dampers closed and the second damper open, and (b) in a second fresh air mode with the second timer control contact closed with the first evaporator energized and the second evaporator de-energized and with the first and third dampers open and the second damper closed, and (c) a third cooling mode with the third timer control contact closed with the first and second evaporators energized and with the first and third dampers closed and the second damper open.

* * * * *